United States Patent [19]

Hou

[11] 4,078,540

[45] Mar. 14, 1978

[54] KEROSENE VAPOR STOVE WITH AUTOMATIC FUEL FEEDING SYSTEM

[76] Inventor: Beshing Hou, No. 33-1, Alley 9, Lane 390, Tun Hua Rd., Taipei, Taiwan, China /Taiwan

[21] Appl. No.: 702,704

[22] Filed: Jul. 6, 1976

[51] Int. Cl.[2] ..... F24C 5/02

[52] U.S. Cl. ..... 126/44; 431/11; 431/37; 431/208; 431/233; 431/247

[58] Field of Search ..... 431/11, 36, 37, 44, 431/208, 232, 233, 247; 126/44

[56] References Cited

U.S. PATENT DOCUMENTS

| | | | |
|---|---|---|---|
| 3,326,262 | 6/1967 | Weller, Jr. et al. | 431/208 X |
| 3,653,794 | 4/1972 | Shakiba | 431/208 |
| 3,768,958 | 10/1973 | Sakai et al. | 431/208 |
| 3,877,458 | 4/1975 | Allander | 126/44 |

*Primary Examiner*—Edward G. Favors
*Attorney, Agent, or Firm*—Holman & Stern

[57] ABSTRACT

This invention relates to a kerosene vapor stove with an automatic fuel feeding system. There are two ways of vaporizing the kerosene. When the stove is about to be lighted, kerosene is channelled into a preliminary preheating tube to be heated up to a high temperature within a short time. The heated kerosene under pressure passes through a nozzle and shoots through an air gap into a mixing tube, vaporizing in the process. The mixture of the kerosene vapor and air is delivered into a burner where it burns. After the stove has been lighted for about two minutes, the loop of tube above the burner will be well heated. This tube is a part of the normal path for kerosene. Kerosene is now channelled through this tube for preheating, utilizing the heat produced by the burner to effect vaporization. The automatic feeding of the kerosene is accomplished through using a steel container containing kerosene up to 80% of its volume. A tube extends from the outlet valve of the container down to its bottom. Compressed air is stored in the upper portion of the container to exert a pressure on the surface of the kerosene which will be forced out of the container into the stove when valve at the top of the kerosene container is turned on.

6 Claims, 8 Drawing Figures

KEROSENE VAPOR STOVE WITH AUTOMATIC FUEL FEEDING SYSTEM

BRIEF SUMMARY OF THE INVENTION

The importance of fuel in our daily life cannot be over emphasized. In rural areas of developing countries, wood and coal are used to produce heat for cooking or warming purposes. In urban areas or in developed countries, coal gas, water gas or liquefied natural gas are often used. In the former case, pollution is a certain result. In the latter, the convenience is shadowed by a menace of potential hazard of gas poisoning or fire breakout due to leakage of gas. Accidents of this source claims a high toll of lives in any country. Further, in some countries, the availability of various types of fuels are not always in the proportion they are needed. In Taiwan, there is often a shortage of gas and an over supply of kerosene.

Because kerosene has a higher ignition point and because its leakage can be more easily detected and it has no problem of gas poisoning, the adoption of kerosene as a fuel can contribute considerably toward the promotion of safety. Unbalance in the supply of various types of fuels, such as in the case of Taiwan, can also be alleviated. This invention provides a stove which utilizes kerosene vapor as fuel to produce a strong blue flame without smoke as in the case of burning wood or coal. The automatic feeding of kerosene as well as the automation of vaporization process and ignition process by means of a timepiece and an electromagnetic valve enable the operation of this kerosene vapor stove with no less convenience than any gas stove, exceeding the convenience of a conventional kerosene stove by far.

DESCRIPTION OF THE PREFERRED EMBODIMENTS

Figure 1:
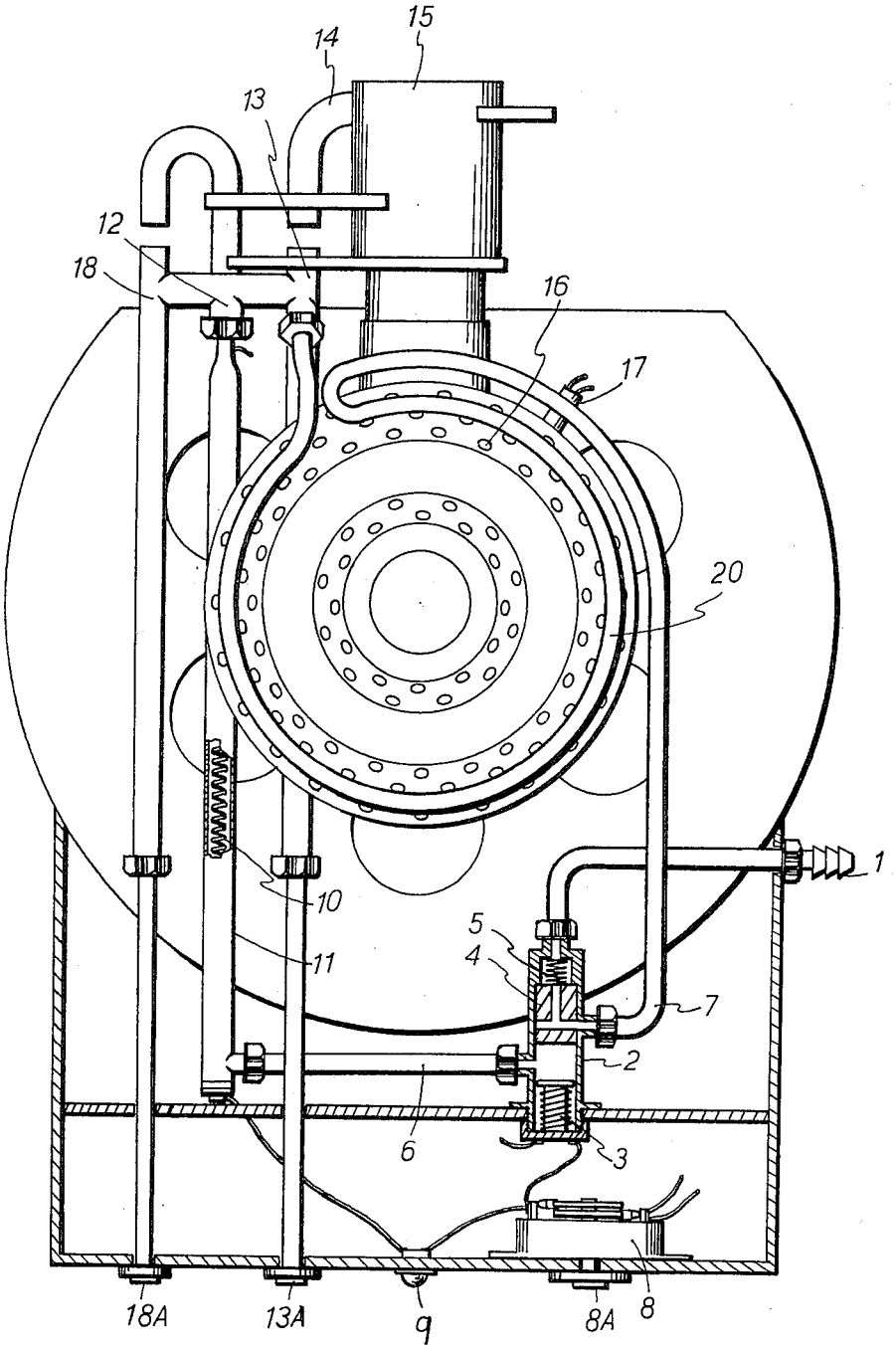
FIG. 1 is a plan view of an embodiment of the invention.

Referring to FIG. 1, 1 is an inlet for kerosene through which kerosene is passed into the stove. A pipe delivers the kerosene to an electromagnetic valve 2 which consists of an electromagnet 3, a soft iron block 4 with a "T" shaped tunnel in it and a spring 5 connecting the soft iron block 4 to a fastening point in the upper part of the electromagnetic valve 2. When the electromagnet 3 is activated, the soft iron block will be pulled down such that the left arm of the "T" shaped tunnel will communicate with a pipe 6. When the electromagnet 3 is off, the spring 5 will pull the soft iron block up such that the right arm of the "T" shaped tunnel will communicate with a pipe 7. The electromagnet 3 of the electromagnetic valve 2 is operated by a two step automatic timer 8A. A wire connects the output terminal of the two step automatic timer 8 to a pilot lamp 9 and then to a heating element 10 inside a preliminary preheating tube 11 which communicates with tube 6 at one of its end. Connected to the other ends of preliminary preheating tube 11 is a transverse tube 12 having one of its ends in communication with a needle valve 13 and another of its ends in communication with another needle 18 valve. Opposite the needle valve 13 is a vaporizing tube 14 which leads into a large mixing tube 15. After the process of mixing in the mixing tube 15, the mixture then emerge from the burner 16 where it burns. The ignition of the burner is effected by an electromagnetic igniter 17 controlled by the two step automatic timer 8 whose operation is to be described later.

Figure 7:
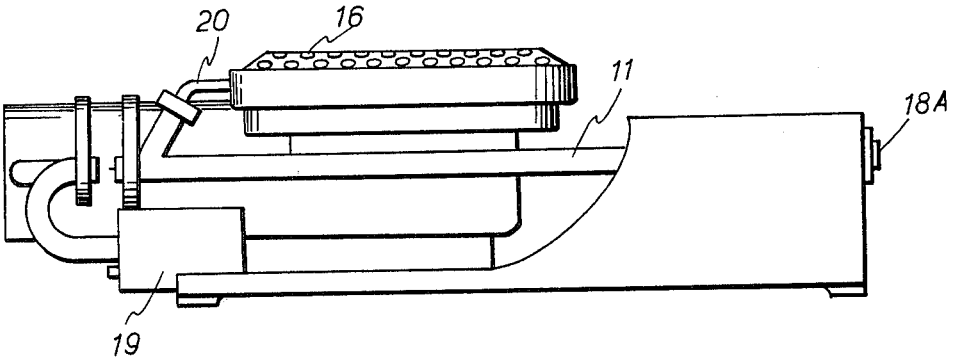
FIG. 7 is a sectional side view of the invention.

The left end of the transverse tube 12 is in communication with the needle valve 18. A vaporizing tube opposite the needle valve 18 leads to an auxiliary burner 19 (see FIG. 7, details not shown) which has a far less supply of fuel than the main burner. The function of the auxiliary burner is to keep a part of the preheating tube 11 and the whole transverse tube 12 at a high temperature. During the process of cooking when the fire is desired to be turned off temporarily, control applied through knob 13A will put out the fire at the main burner 16 while the auxiliary burner 19 is kept burning. When the main burner is desired to be lit again, it is now not necessary to go all the way through the preliminary preheating procedure once more because the transverse tube 12 is kept heated by the auxiliary burner 19.

Tube 7 extending from the electromagnetic valve 2 toward the burner 16 bends into a loop 20 encircling the burner 16. The other end of the loop 20 is connected to the transverse tube 12.

Figure 8:
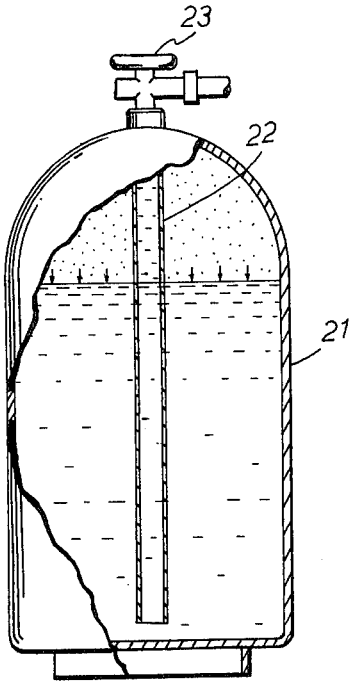
FIG. 8 is a sectional front view of the steel container.

Referring to FIG. 8, the fuel kerosene for the stove is stored in a steel container 21 which has a central tube 22 to drain the kerosene. Compressed air is introduced into the upper part of the container 21 so that a pressure will be exerted on the liquid surface to force the kerosene up the central tube 22 when a valve 23 on the top of the steel container 21 is opened.

Figure 6:
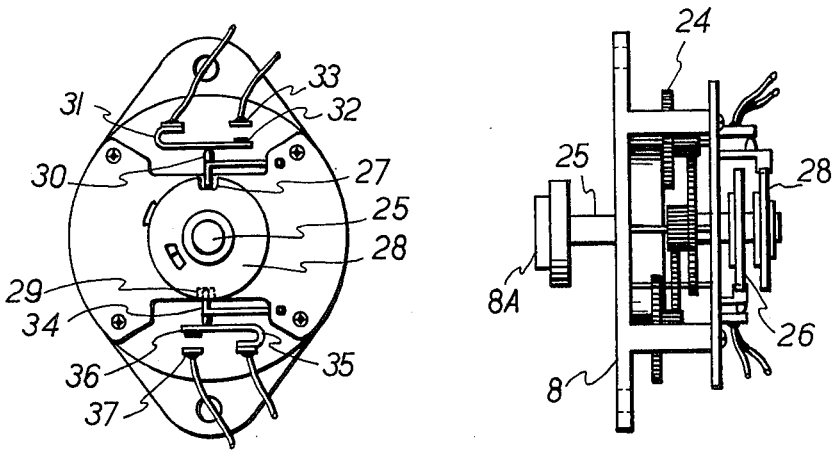
FIG. 6 shows the sectional side view and plan view of the two step automatic timer.

FIG. 6 shows the structure of the two step automatic timer 8. Gear train 24 is identical with the gear train in an ordinary timer, with gears and spring connected together such that the shaft 25 will have a fixed speed of turning. Control disc 26 with a recess 27 is mounted rigidly to the shafts 25. Another control disc 28 with a recess 29 is also rigidly mounted to the shaft 25 outside the control disc 26. A rider 30 slides over the edge of the control disc 26 when the disc is rotating. A flexure spring 31 carrying a contact terminal 32 is kept in a bending position by the rider 30 so that the contact terminal 32 is touching an opposite contact terminal 33. When the rider 30 falls into the recess 27, pressure on the flexure spring 31 is released and contact terminal 32 will part with the contact terminal 33. This continuation of control disc 26, rider 30 and contact terminals 32 and 33 is used to break the circuit of the electromagnetic valve 2 and that of the heating coil 10. The elements of the other continuation, namely, rider 34, flexure spring 35, contact terminals 36 and 37 are in identical relationship among one another except that this continuation is to be used to break the circuit of the electromagnet 38 of the igniter 17.

Figure 5:
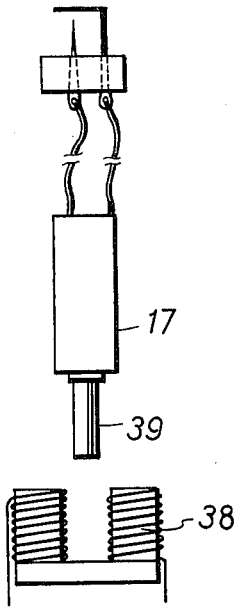
FIG. 5 shows the igniter of the invention.

FIG. 5 is a diagram of the igniter 17. When current passes through the coil of the electromagnet 38, the resulting magnetic force will pull down a soft iron rod 39. When current is cut off, the soft iron rod will be released and pulled back by a (not shown) spring, activating a well-known striker (not shown) on its way back. The striker will emit sparks that will ignite the kerosene vapor.

Figure 2:
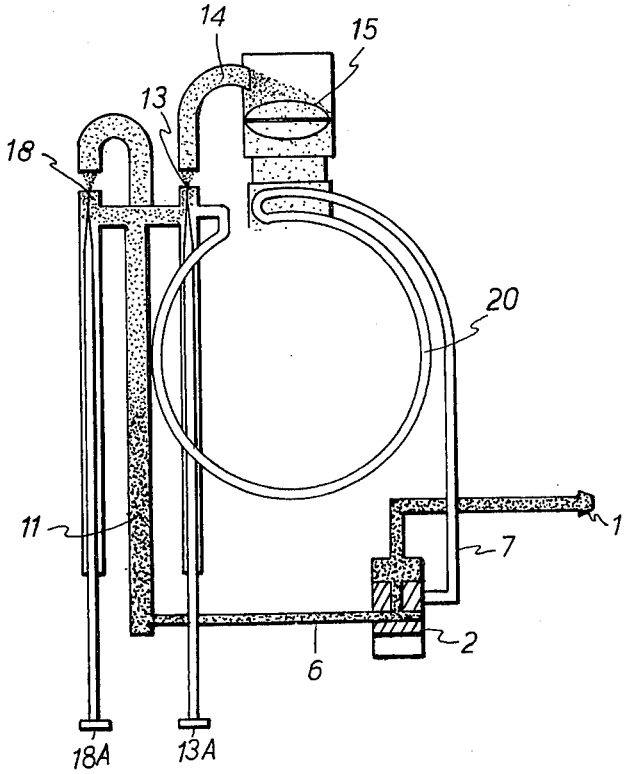
FIG. 2 shows the preliminary path of vaporization at the beginning stage of using the stove.
Figure 3:
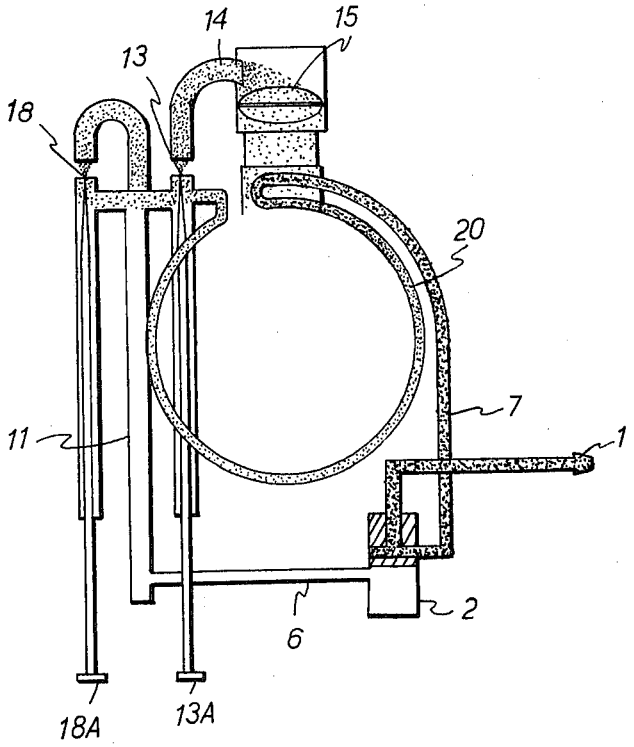
FIG. 3 shows the normal path of vaporization when the stove is being used.
Figure 4:
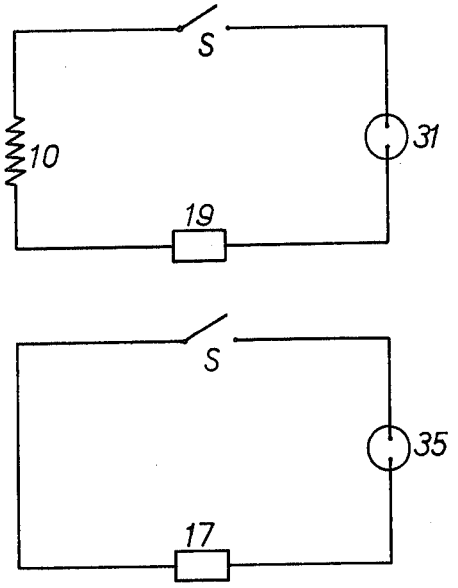
FIG. 4 is a circuit diagram of the invention showing a two step automatic timer.

Having described the structure of the kerosene vapor stove with automatic fuel feeding system, we shall now look into the operation of the stove. Before using the stove, make sure that the control knobs 13A and 18A are in such a position that the passages of the needle valves 13 and 18 are blocked by their respective needles. Turn the control knob 8A of the two step automatic timer to the rightmost position. This action will cause the riders 30 and 34 to come out of the recesses 27 and 29, pressing the contact terminal 32 against 33 and 36 against 37 and making the circuit of the heating coil 10 and the electromagnetic coil 3 which are in series connection. The electromagnet wil then pull down the soft iron block 4, causing the pipe 6 to come into communication with inlet 1 through the "T" shaped tunnel in the soft iron block 4. Turn on the valve 23 at the top of the steel container 21 immediately thereafter to allow kerosene to flow into the preliminary preheating tube 11 before the heating coil 10 becomes too hot. Allow the stove to stand under such condition for 35 seconds, then adjust control knobs 13A and 18A to allow a small amount of kerosene to shoot out of the needle valves 13 and 18. The emitted kerosene will vaporize and the vapor mixture will emerge at the main burner and auxiliary burner, see FIG. 2. At 40 seconds after the activation of the two step automatic timer 8, the rotating shaft 25 is at such a position that the rider 34 will now fall into the recess 29 and the contact terminals 36 and 37 will be separated from each other. At this point, the circuit of the electromagnet 38 of the igniter 17 bein open, the soft iron rod is released to activate the striker which then emits sparks to ignite the main burner. The auxiliary burner is also ignited at the same time by a separate igniter (not shown in figures) connected in parallel with igniter 17. Control knob 13A is now adjusted to allow a higher flame at the burner. The loop 20 is now being gradually heated up by the main burner. About two minutes after the activation of the two step automatic timer 8, the rotating shaft will be in such a position that the rider 30 will be separated therefrom. At this point, the circuit of the heating coil 10 and the electromagnet 3 in series is open. The heating coil will stop heating and the electromagnet 3 will release the soft iron block which is then pulled up by the spring 5. Now the passage of kerosene into tube 6 is disconnected. Kerosene is channelled into tube 7 instead. After being heating during its passage through the loop 20, the hot kerosene is then delivered into the transverse tube 12 and then emitted through the needle valves 13 and 18. See FIG. 3. After using the stove, just turn the valve 23 and the control knobs 13A and 18A tight to block the passage of the valve 23 and the needle valves 13 and 18.

I claim:

1. A kerosene vapor stove comprising:

a burner;

vaporization means including a preliminary preheating means and a normal preheating means, the preliminary preheating means comprising a preheating coil and a circuit associated therewith and the normal preheating means comprising a loop which encircles the burner to absorb heat therefrom for preheating of the kerosene;

an electromagnetic changeover valve for controlling the preliminary preheating means and the normal preheating means, the valve having a circuit associated therewith;

a two-step automatic timer for controlling the electromagnetic changeover valve;

a needle valve for regulating the flow of the kerosene;

a kerosene container made of steel;

means for introducing compressed air into the kerosene container in order to exert pressure on the kerosene to drive the kerosene through the stove; and, an igniter having a circuit controlled by the timer, the igniter having a striker and emitting sparks when the circuit is broken by the timer, the timer acting to complete the circuit of the preheating coil and the circuit of the electromagnetic changeover valve and the circuit of the igniter when said timer is activated, the timer breaking the circuit of the igniter forty seconds after completion thereof and breaking the circuits of the preheating coil and of the valve two minutes after completion thereof to cause changeover from the preliminary preheating means to the normal preheating means, the burner being fed by either of the preheating means.

2. The apparatus of claim 1 wherein the burner comprises a main burner and an auxiliary burner, the preliminary preheating means comprising an electromagnetic valve, a preheating tube having the preheating coil disposed therein, a first needle valve for controlling the main burner, a vaporizing tube, a mixing tube leading to and feeding the main burner, a second needle valve for the auxiliary burner, and a vaporizing and mixing tube leading to and feeding the auxiliary burner.

3. The appartus of claim 1 wherein the means for introducing compressed air into the kerosene container comprises a central tube in the container and an outlet valve for controlling the flow of compressed air into the container.

4. The apparatus of claim 2 wherein the normal preheating means is connected to the electromagnetic changeover valve at one end and connected to the tube at the other end.

5. The apparatus of claim 4, wherein an air gap is formed between the needle valve and the vaporizing tube, thereby permitting an inflow of air into the varporizing tube and mixing tube.

6. The apparatus of claim 1 and further comprising a main shaft, the two step automatic timer comprising a train of gears and a spring to limit the turning of the main shaft at a specific speed, two control discs being rigidly attached to the main shaft, each control disc having a recess and each disc being provided with a rider, a flexure spring and a pair of contact terminals.

* * * * *